US005921313A

United States Patent [19]

Niemann et al.

[11] Patent Number: 5,921,313

[45] Date of Patent: Jul. 13, 1999

[54] PROCESS AND DEVICE FOR CASTING A BILLET OF LIQUID METAL

[75] Inventors: Martin Niemann, Erlangen; Dietrich Wohld, Rauschenberg; Jürgen Adamy, Igensdorf; Hans-Joachim Nitsche, Erlangen, all of Germany

[73] Assignee: Siemens Aktiengesellschaft, Münich, Germany

[21] Appl. No.: 08/940,038

[22] Filed: Oct. 2, 1997

[30] Foreign Application Priority Data

Oct. 2, 1996 [DE] Germany ..... 196 40 806

[51] Int. Cl.[6] ..... B22D 11/18; B22D 11/06; B22D 11/20

[52] U.S. Cl. ..... 164/453; 164/151.3; 164/151.1; 164/155.4; 164/155.5; 164/428; 164/480; 164/454

[58] Field of Search ..... 164/453, 151.3, 164/151.1, 155.4, 155.5, 428, 480, 454

[56] References Cited

U.S. PATENT DOCUMENTS 5,311,924 5/1994 Asano et al. ..... 164/453

FOREIGN PATENT DOCUMENTS 44 04 148 A1 8/1995 Germany .
195 08 476 A1 9/1996 Germany .
5-177321 7/1993 Japan ..... 164/453
6-79423 3/1994 Japan ..... 164/453

*Primary Examiner*—Patrick Ryan
*Assistant Examiner*—I.-H. Lin
*Attorney, Agent, or Firm*—Kenyon & Kenyon

[57] ABSTRACT

A process and system for casting a billet of liquid metal. The liquid metal is cast into a casting die and drawn from the casting die as a billet having a solidified investment and a liquid core. The liquid metal level in the casting die is regulated to a predetermined reference value. Disturbance variables, which act on the liquid metal level in the casting die and which cause a deviation between the actual value and the reference value of the liquid metal level, are estimated, and the influence of the disturbance variables on the actual value of the liquid metal level is compensated or reduced using the estimated disturbance variables.

14 Claims, 3 Drawing Sheets

PROCESS AND DEVICE FOR CASTING A BILLET OF LIQUID METAL

FIELD OF THE INVENTION

The present invention relates to a process and a device for casting a billet of liquid metal. The liquid metal is cast into a casting die and then drawn from the casting die as a billet with a solidified investment and a liquid core.

BACKGROUND OF THE INVENTION

In continuous casting, a billet is cast from liquid metal using a casting die. The billet is drawn from the casting die with a solidified investment and a liquid core. A significant factor for a good quality billet is keeping the casting level, i.e. the liquid metal level in the casting die, constant. The casting level can be regulated. Designing the regulator for the casting level is difficult because the parameters of the controlled system, i.e. the casting apparatus and the casting die, are subject to great variations, to a certain extent. In addition, the design of the regulator for the casting level is further complicated because disturbance variables act on the casting level. In continuous casting, the billet leaves the casting die while it is still soft. The billet is guided on support rollers in a take-up device. Bulging of the billet occurs between the support rollers that has an effect on the casting level in the casting die.

SUMMARY OF THE INVENTION

The present invention provides a process for casting a billet of liquid metal using a casting die. The process keeps the level of the liquid metal in the casting die constant. The process of the present invention provides better level control than conventional processes, particularly when typical disturbances occur. The present invention also provides a device for implementing the process.

The casting level, i.e. the liquid metal level in the casting die, is regulated using a regulator, and disturbance variables which act on the liquid metal level in the casting die are estimated. The influence of the disturbance variables on the actual value of the liquid metal level and the casting die is compensated, or reduced, using the estimated disturbance variables.

It is advantageous to add (or subtract) a correction value which represents the disturbance value to be compensated, to the reference value for the liquid metal level in the casting die. It is advantageous if a regulator, to influence the in-flow of liquid metal into the casting die, has a filling level regulator and a controlling element regulator, e.g. a stopper position regulator. The filling level regulator determines a reference value for the controlling element regulator, for example a stopper position reference value, from the deviation between the reference value of the liquid metal level in the casting die and the actual value of the liquid metal in the casting die. The controlling element regulator regulates the actual, i.e. final, controlling element for influencing the liquid metal level in the casting die as a function of the difference between a corresponding actual value and a corresponding reference value. The regulator can be a stopper position regulator, for example, if the metal in-flow into the casting die is regulated via a stopper. In such a two-part regulator structure, it is preferable to change not the reference value for the liquid metal level in the casting die, but rather the reference value for the controlling element regulator, i.e. the stopper position reference value, using a correction value which represents the disturbance variables.

When casting a billet of the liquid metal, which is cast into a casting die and drawn from the casting die as a billet having a solidified investment and a liquid pool tip, i.e. a liquid core, using driven rollers, variations in the liquid metal level in the casting die are brought about in that the driven rollers are pressed against the billet, and the rollers cause a deformation of the billet in the region of the billet using the liquid pool tip. The process according to the present invention is particularly suitable for compensating such type of disturbance.

It is advantageous if estimating the disturbance variables which are to be compensated or reduced using the process according to the present invention takes place as a function of the actual value of the liquid metal level in the casting die, of the in-flow of the liquid metal into the casting die (or an equivalent variable), and of the casting or billet speed. If the in-flow is influenced using a stopper, for example, the stopper position actual value, for example, is a variable equivalent to the in-flow of the liquid metal into the casting die. If the in-flow is influenced using a different valve-type element, rather than a stopper, its opening, for example, is a variable equivalent to the in-flow of the liquid metal into the casting die.

DETAILED DESCRIPTION OF THE INVENTION

Figure 1:
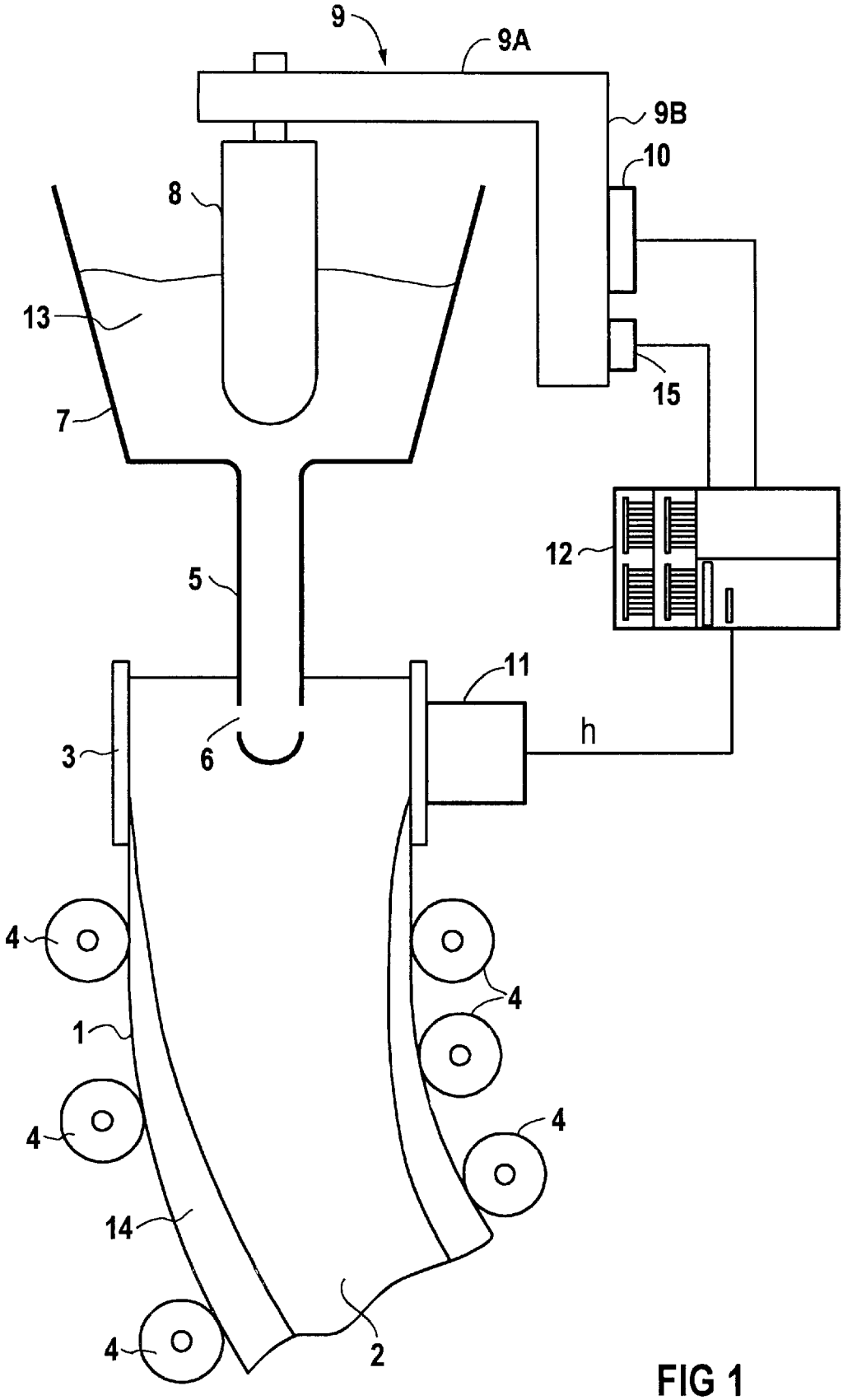
FIG. 1 shows a side view of a device for continuous casting according to the present invention.

In the device according to FIG. 1, liquid metal 13, for example steel, is cast into a distributor channel 7. From the distributor channel 7, the liquid metal 13 flows via an immersion tube 5 with an outlet opening 6, into a casting die 3. In the casting die 3, a billet 1 forms from the liquid metal 13. The billet 1 is drawn from the casting die 3 via rollers 4. The in-flow of the liquid metal 13 into the casting die 3, via the immersion tube 5, is influenced using a stopper 8. The stopper 8 is moved by a mechanical device 9, which has a support arm 9A and a lifter rod 9B. The lifter rod 9B is driven by a hydraulic cylinder 10, which is regulated via a programmable controller 12, and moved in the vertical direction. The vertical position is measured using a position measurement device 15 and transmitted to the programmable controller 12. In addition, the device has a casting die filling level measurement device 11, which is connected to transmit data to the programmable controller 12, which is similar to the position measurement device 15 and the hydraulic cylinder 10. The programmable controller 12 regulates level h of the liquid metal 13 in the casting die 3. The billet 1, which is drawn from the casting die 3, has a liquid pool tip, i.e. a liquid core 2, and a solidified investment 14.

Figure 2:
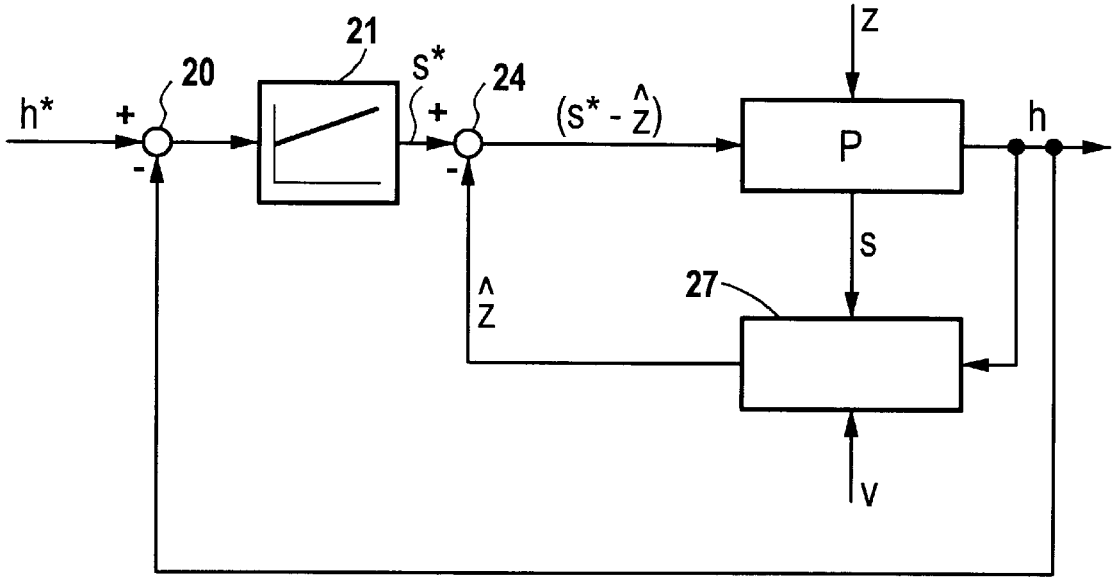
FIG. 2 shows a filling level regulator circuit with a disturbance variable monitor.

FIG. 2 shows a filling level regulator circuit with a disturbance variable monitor 27. h* is a reference value of the liquid metal level in the casting die 3, from which a measured actual value h of the liquid metal level in the casting die 3 is subtracted using a summation point 20. The difference between the reference value h* and the actual value h is provided, as a control deviation, to a filling level regulator 21 which is structured as a PI regulator. Using the filling level regulator 21, a casting process P is regulated by a stopper position reference value s*.

In this exemplary embodiment of the present invention, the casting process P includes not only the actual casting but also the stopper position regulation to regulate the position of the stopper 8. Between the filling level regulator 21 and the stopper position regulator, a correction value $\hat{z}$ is feed-forwarded using a correction element 24. The correction value models disturbance variables z acting on the casting process P, particularly the disturbance variables which are caused by the rollers 4. The correction value $\hat{z}$ is used to correct the output of the filling level regulator 21. Therefore, a corrected stopper position reference value $(s^*-\hat{z})$ is applied to the casting process P. The correction value $\hat{z}$ for compensating the disturbance variables z is formed by the disturbance variable monitor 27 as a function of the actual value s of the stopper position, of the actual value h as well as of a casting velocity or of a billet velocity v.

Figure 3:
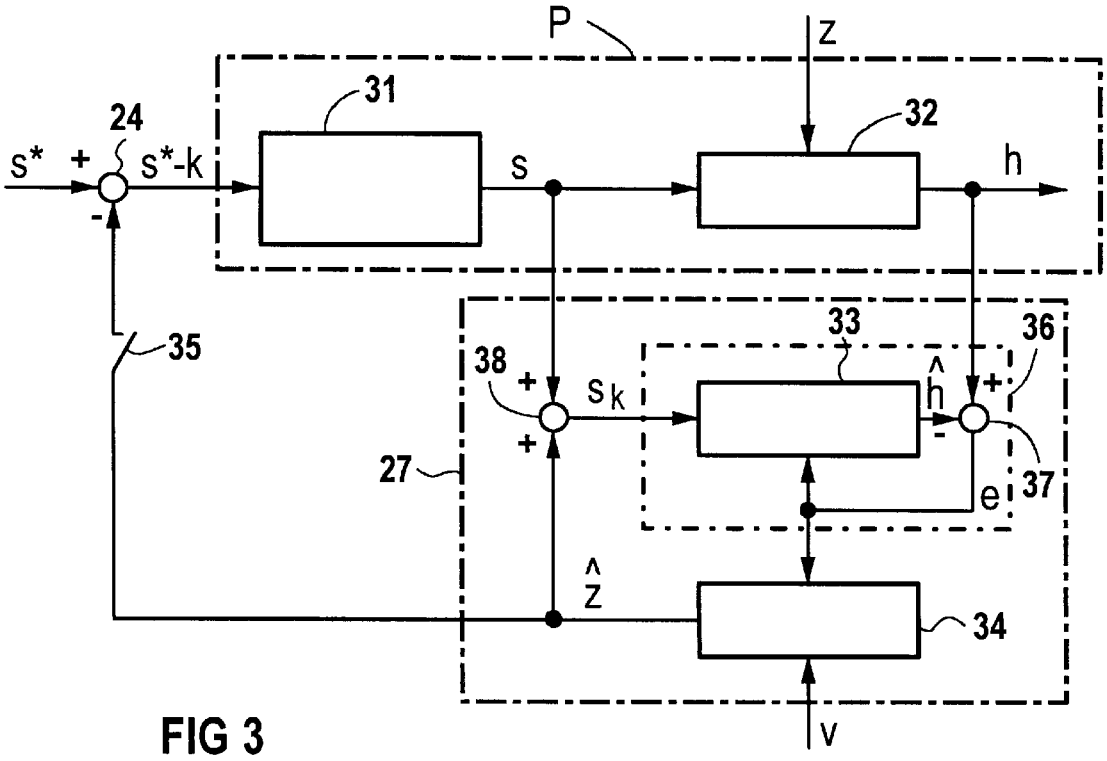
FIG. 3 shows the structure of a disturbance variable monitor.

FIG. 3 shows the structure of the special disturbance variable monitor 27 in connection with other components shown in FIG. 2. In FIG. 3, s* refers to the stopper position reference value, i.e. the output of the filling level regulator 21. Reference symbol 31 refers to a stopper position regulation with hydraulics for stopper positioning, and reference symbol 32 refers to the casting process without hydraulics for stopper positioning. The disturbance variable monitor 27 has a casting process monitor 36 and a disturbance variable model 34. The casting process monitor 36 has a casting process model 33 to form an estimated actual value $\hat{h}$ as a function of a corrected actual value $s_k$ of the stopper position. A monitor error e is formed as the difference between the actual value h and the estimated actual value $\hat{h}$ by summation point 37. The disturbance variable model 34 forms the estimated disturbance variable $\hat{z}$ as a function of the monitor error e and the casting velocity v. A corrected stopper position reference value $(s^*-\hat{z})$ is formed from the difference between the stopper position reference value s* and the estimated disturbance variable $\hat{z}$. The corrected stopper position reference value $(s^*-\hat{z})$ is the input variable into the stopper position regulation 31 with hydraulics for the stopper positioning.

FIG. 3 shows another exemplary embodiment in which a switch 35 is used to optionally apply the estimated disturbance variable $\hat{z}$ used as the correction value. It is advantageous to apply the correction value via a personal computer user interface. The disturbance variable monitor 27 replicates the disturbance variables z using the estimated disturbance variables $\hat{z}$ in the optimum way possible.

Figure 4:
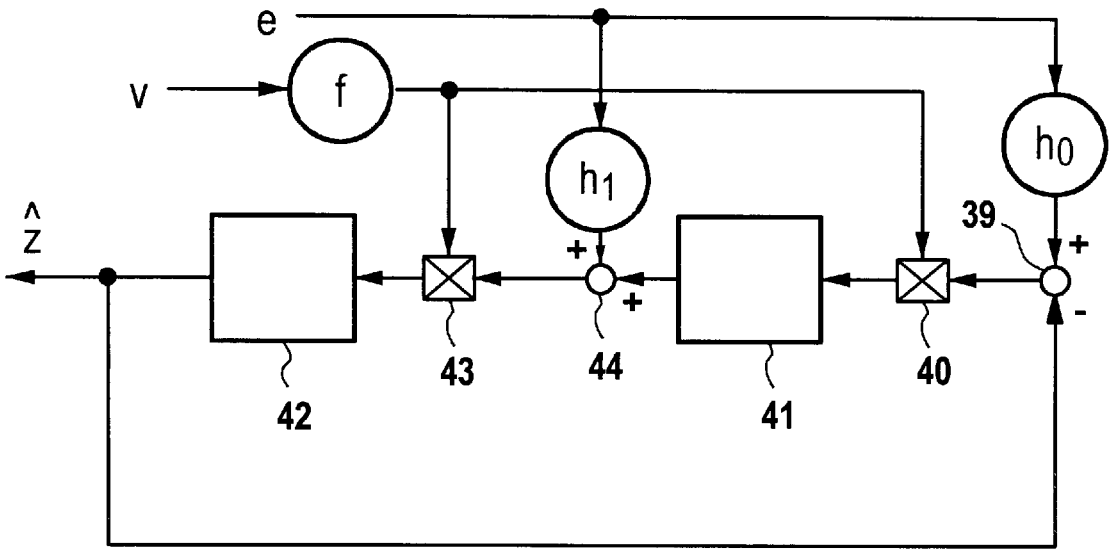
FIG. 4 shows a disturbance variable model.

FIG. 4 shows the disturbance variable model 34 for forming the estimated disturbance variables $\hat{z}$ as a function of the monitor error e and the casting velocity v. The disturbance variable model 34 has a series circuit of two integrators 41 and 42.

First, the casting velocity v is multiplied by a factor f. The difference between the monitor error e, which is multiplied by a weight of $h_0$, and the estimated disturbance variable $\hat{z}$, is multiplied by the casting velocity v, which is multiplied by the factor f. This product is applied as an input to the first integrator 41. The difference between the monitor error e, multiplied by $h_0$, and the estimated disturbance variable $\hat{z}$, is formed using a summation point 39. The monitor error e, which is first multiplied by a weight of $h_1$, is added to the output variable of the first integrator 41, using a summation point 44. The sum is multiplied by the casting velocity v, multiplied by the factor f, using a multiplier 43. The product is the input variable of the second integrator 42. The output variable of the second integrator 42 is the estimated disturbance variable $\hat{z}$.

Figure 5:
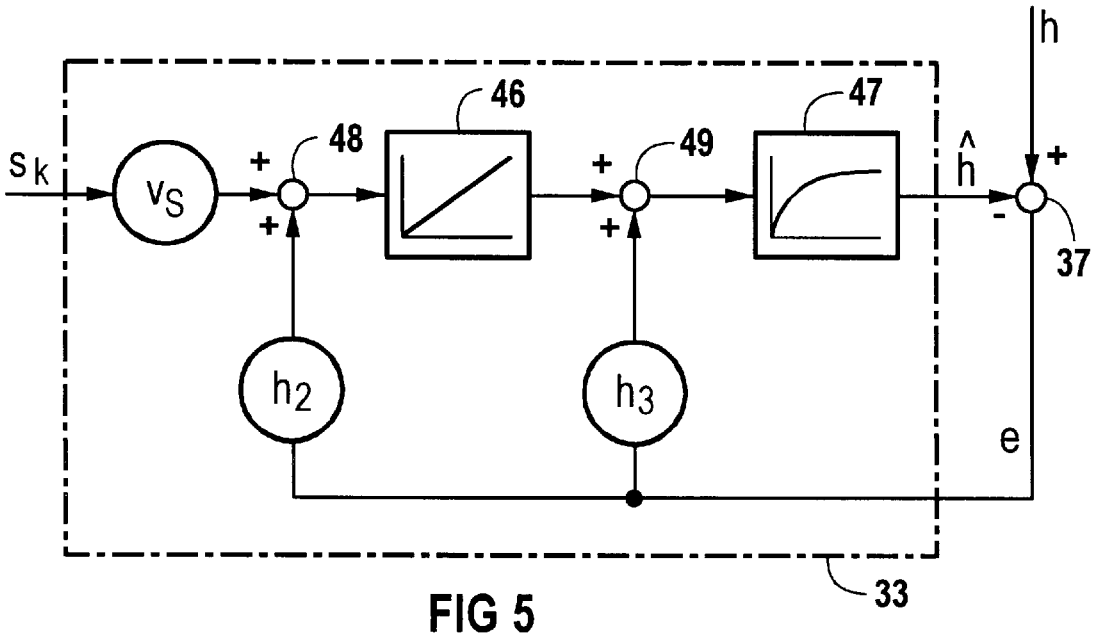
FIG. 5 shows a casting process monitor.

FIG. 5 shows a casting process monitor which forms the estimated actual value $\hat{h}$, of the level of liquid metal in casting die 3, using a casting process model 33 as a function of the corrected stopper position actual value $s_k$. The monitor error e is formed as the difference between h and $\hat{h}$. The corrected stopper position actual value $s_k$ is multiplied by an amplification $v_s$ for modeling the relationship between the stopper position s and metal through-flow. The monitor error e, multiplied by a weight $h_2$, is added to the product, using a summation point 48. The sum is the input variable of an integrator 46. The product of a weight $h_3$ and the monitor error e is added to the output variable of the integrator 46, using a summation point 49. The sum is the input variable for a PI element 47, which outputs the estimated actual value $\hat{h}$.

What is claimed is:

1. A process for casting a billet of a liquid metal, comprising the steps of:

casting the liquid metal into a casting die;

drawing the liquid metal from the casting die as the billet having a solidified investment and a liquid core;

regulating a liquid metal level in the casting die to a predetermined reference value;

estimating disturbance variables using an oscillator, wherein the disturbance variables correspond to the at least one variation of the liquid metal level in the casting die;

establishing a frequency, an amplitude, and a phase position of vibrations produced by the oscillator as a function of a difference value and the casting velocity, the difference value being determined as a function of an actual value of the liquid metal level and an estimated actual value of the liquid metal level in the casting die; and adjusting the influence of the disturbance variables on an actual value of the liquid metal level in the casting die utilizing the estimated disturbance variables.

2. The process according to claim 1, further comprising the steps of:

extracting the billet from the casting die at a casting velocity using driven rollers which are pressed against the billet, wherein a pressure of the driven rollers in a region of the billet with the liquid core results in a deformation of the billet which causes at least one variation in a liquid metal level in the casting die;

treating and estimating the variations as disturbance variables which influence the casting process; and adjusting the variations using the estimated values.

3. The process according to claim 2, further comprising the step of:

estimating the disturbance variables as a function of at least one of an amount of an in-flow of the liquid metal provided into the casting die and a casting velocity.

4. The process according to claim 1, wherein the estimate of the disturbance variables takes place as a function of the actual value of the liquid metal level in the casting die.

5. The process according to claim 1, further comprising the steps of:

regulating the liquid metal level in the casting die with a filling level regulator as a function of the actual value and the predetermined reference value; and changing the predetermined reference value as a function of the estimated disturbance variables to adjust an influence of the disturbance variables on the actual value.

6. The process according to claim 1, further comprising the steps of:

influencing the liquid metal level in the casting die using a valve-like element;

regulating an in-flow of the liquid metal as a function of the actual value and the predetermined reference value using the valve-like element and an in-flow regulator; and changing the predetermined reference value as a function of the estimated disturbance variables to adjust an influence of the disturbance variables on the actual value.

7. The process according to claim 1, further comprising the steps of:

controlling a position of a stopper to influence an in-flow of the liquid metal into the casting die and the liquid metal level in the casting die;

regulating the stopper position using an in-flow regulator as a function of the actual value and a further reference value of the stopper position; and changing the further reference value as a function of the estimated disturbance variables to adjust an influence of the disturbance variables on the actual value.

8. The process according to claim 1, further comprising the steps of:

estimating the disturbance variables using a disturbance variable monitor, the disturbance variable monitor including a casting process monitor and a disturbance variable model;

modeling the casting of the liquid metal without an influence of the disturbance variables using the casting process monitor; and modeling the disturbance variables using the disturbance variable model.

9. The process according to claim 1, further comprising the step of:

switching on an adjustment of an influence on the disturbance variables.

10. A device for casting a billet of a liquid metal, comprising:

a casting die, the liquid metal being cast in the casting die and being drawn from the casting die as the billet, the billet having a solidified investment and a liquid core;

a stopper, wherein a position of the stopper influences an in-flow of the liquid metal into the casting die;

an in-flow regulator regulating the stopper position as a function of a difference between an actual value and a reference value of the stopper position; and a correction element correcting the reference value, the correction element being positioned in front of the in-flow regulator.

11. The device according to claim 10, wherein the correction element includes a summing unit.

12. The device according to claim 10, wherein the correction element includes a summing unit which combines the reference value and a correction value.

13. The device according to claim 12, further comprising:

a disturbance variable monitor determining the correction value.

14. The device according to claim 13, wherein the disturbance variable monitor includes a casting process monitor and a disturbance variable model.

* * * * *